US005165650A

United States Patent [19]

Letizia

[11] Patent Number: 5,165,650

[45] Date of Patent: * Nov. 24, 1992

[54] PICTURE ANCHORING APPARATUS

[76] Inventor: Louis S. Letizia, 3220 N. Blue Ridge Ct., Westlake Village, Calif. 91362

[ * ] Notice: The portion of the term of this patent subsequent to Jan. 14, 2009 has been disclaimed.

[21] Appl. No.: 817,061

[22] Filed: Jan. 6, 1992

Related U.S. Application Data

[63] Continuation-in-part of Ser. No. 628,466, Sep. 17, 1990, Pat. No. 5,080,317.

[51] Int. Cl.[5] ..... A47F 1/14

[52] U.S. Cl. ..... 248/467; 248/542

[58] Field of Search ..... 248/494, 544, 466, 467, 248/475.1, 489, 216.1, 217.2, 217.3, 493, 497

[56] References Cited

U.S. PATENT DOCUMENTS

| | | | |
|---|---|---|---|
| D. 235,308 | 6/1975 | Clarke | 248/494 X |
| 2,492,411 | 12/1949 | Barnes | 248/494 X |
| 2,879,018 | 3/1959 | Pence | 248/494 |
| 4,085,917 | 4/1978 | Brantley | 248/489 |
| 4,094,490 | 6/1978 | Einhorn | 248/489 |
| 4,169,308 | 10/1979 | Minogue | 248/489 X |
| 4,557,457 | 12/1985 | Cockfield | 248/544 |
| 4,610,419 | 9/1986 | Swanson | 248/547 |
| 4,804,161 | 2/1989 | Wallo | 248/489 X |
| 5,080,317 | 1/1992 | Letizia | 248/466 |

*Primary Examiner*—J. Franklin Foss
*Attorney, Agent, or Firm*—Jack C. Munro

[57] ABSTRACT

A picture anchoring apparatus for fixedly positioning a framed picture on a vertical wall surface. The anchoring apparatus utilizes a fastener which has a sharp pointed penetrating member extending from a malleable metal strip. On the outer surface of the malleable metal strip is placed an adhesive pad. The adhesive pad is to be mounted on the frame of a picture with the sharp pointed end to penetrate the wall surface. The fasteners are to be contained within an elongated body which is divided into a pair of storage chambers with a level vial being included within the body separating the storage chambers. The level vial is to be utilized by the user to establish a substantially precise level position for the picture frame prior to physically causing the sharp pointed end of the fasteners to penetrate the wall surface.

4 Claims, 1 Drawing Sheet

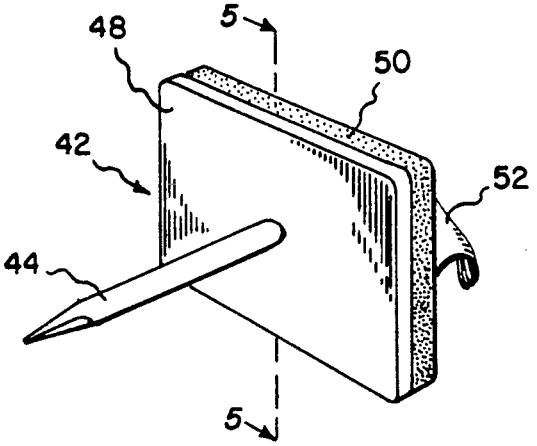
FIG. 4
FIG 3
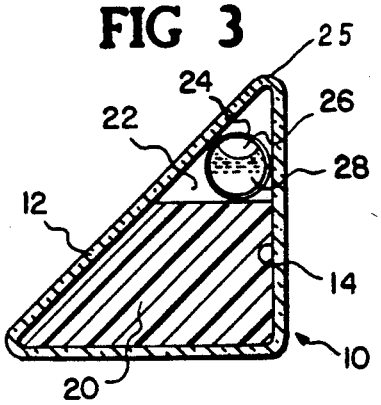
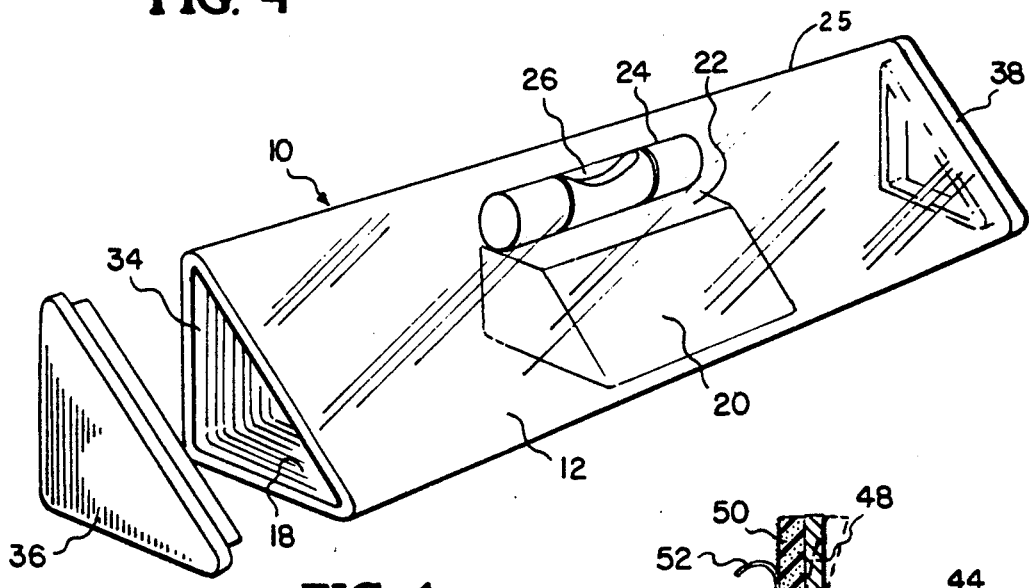
FIG. 1
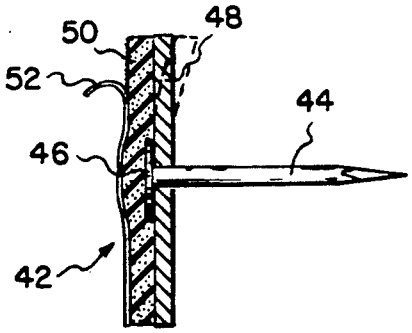
FIG. 5
FIG. 2
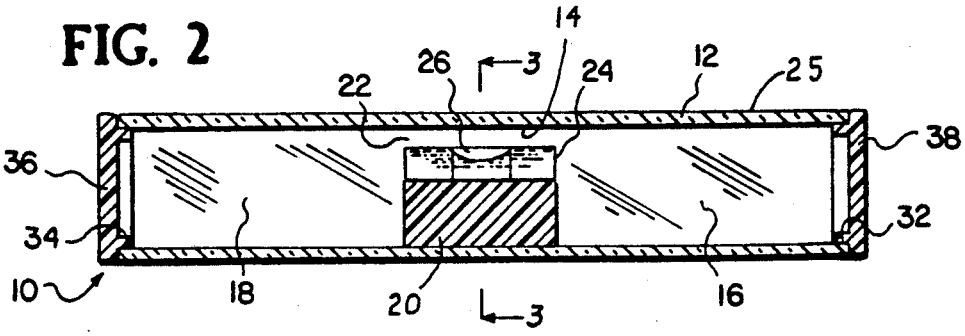

PICTURE ANCHORING APPARATUS

REFERENCE TO PRIOR APPLICATION

This application is a continuation-in-part of U.S. Pat. application Ser. No. 07/628,466, filed Sept. 17, 1990, entitled "PICTURE ANCHORING APPARATUS", by the present inventor, now patent no. 5,080,317, issued Jan. 14, 1992.

BACKGROUND OF THE INVENTION

1. Field of the Invention

The field of this invention relates to an anchoring apparatus for framed pictures and more particularly for anchoring apparatus which can be utilized so that the framed picture can be mounted on a vertical wall surface so that the upper edge of the picture is horizontal and the resulting picture will remain in that position and not be skewed.

2. Description of the Prior Art

In the hanging of pictures on the walls, it is common to hang pictures by a hook or nail with a small fastener, wire or cord being mounted on the frame of the picture. The fastener, wire or cord is to be supported on the nail or hook which is mounted in the wall.

Most pictures are mounted within frames. The common most frame is generally rectangular. It is generally desired to have the upper edge of the frame be located precisely horizontal. Invariably the horizontal positioning of the framed picture shifts to a slightly skewed position. This skewing of the framed picture may be due to vibration or settling of the house or building within which the framed picture is mounted. The skewing of the picture can also occur by rapid circulation of air within a room, by means of misaligning of the framed picture during cleaning, by earthquake or for numerous other reasons.

Constant realigning of pictures within a house or building is certainly annoying. In the past, there have been attempts at designing devices to eliminate framed picture misalignment. One such device is shown within the aforementioned U.S. patent application 07/628,466. This aforementioned patent application utilizes a particular type of fastener that is pointed on opposite ends with one end of the pointed fastener to be imbedded within the picture frame and the opposite end of the pointed fastener to be embedded within the wall. This embedding of the fastener is to be at the lower inside edge of the picture frame. This type of an embedding fastener can not be used on a picture frame that is metallic. Therefore, for picture frames that are constructed of material other than wood, the pointed end type of fastener cannot be utilized.

SUMMARY OF THE INVENTION

The picture anchoring apparatus of this invention is designed to be utilized in conjunction with a fastener which has a single pointed end and a planar adhesive surface at the opposite end. The adhesive surface of the fastener is to be placed against the lower bottom member of a picture frame. This adhesive surface is mounted on a malleable strip of metal which can be deformed to accommodate to the particular shape of the picture frame member if such is not planar. The picture anchoring apparatus includes an elongated body which also includes a level vial so that the body can than be placed on the upper edge of the picture frame and then by slightly pivoting the picture frame the user can observe at what point the upper surface of the picture frame is horizontal and at that time the pointed end of the fastener is then caused to penetrate the wall surface. The framed picture will then be maintained in that position and skewing of the picture will be prevented. The elongated body includes storage compartments for the fastener and for picture hanging hooks (not shown).

The principal objective of the present invention is to construct an apparatus which is to be used to fixedly position a picture frame on a wall in a horizontally aligned position and cause that picture frame to be maintained in that position regardless of ambient motion occurrences such as vibration, air currents, earthquakes and so forth.

Another objective of the present invention is to construct a picture anchoring apparatus which is simple to utilize thereby not requiring a great degree of skill by the user.

Another objective of the present invention is to construct a picture anchoring apparatus which can be manufactured at a relatively inexpensive price and thereby sold to the ultimate consumer at an inexpensive price.

BRIEF DESCRIPTION OF THE DRAWING

FIG. 1 is a perspective view of the picture anchoring apparatus of this invention showing an end cap of the body of the picture anchoring apparatus removed;

FIG. 2 is a longitudinal cross-sectional view through the elongated body of the picture anchoring apparatus of this invention;

FIG. 3 is a transverse cross-sectional view through the elongated body of the picture anchoring apparatus of this invention taken along line 3—3 of FIG. 2;

FIG. 4 is an isometric view of the fastener which is to be utilized in conjunction with the picture anchoring apparatus of this invention; and FIG. 5 is a cross-sectional view taken along line 5—5 of FIG. 4 showing the internal construction of the fastener of FIG 4.

DETAILED DESCRIPTION OF THE SHOWN EMBODIMENT

Referring particularly to the drawing, there is shown the picture anchoring apparatus 10 of this invention. The apparatus 10 is composed primarily of an elongated body 12 which is shown of a triangular, polygonal .configuration in transverse cross-section. Elongated body 12 is hollow forming a center interior chamber 14. On one side of the interior chamber 14 is an interior storage chamber 16. On the opposite side of interior chamber 14 is an interior storage chamber 18. Securely mounted within the interior compartment 14 is a block 20. Block 20 will be of a rigid material such as plastic.

Block 20 includes a cutout area 22. Located within this cutout area 22 is a transverse plastic or glass vial 24. The surface of the vial 24 that is located near the uppermost edge 25 of the body 12 is formed slightly arcuate. Within the vial 24 is located a liquid 2B and an air bubble 26. Vial 24 is fixedly mounted to the block 20. The position of the air bubble 26 is readily visually observable since the wall of the elongated body 12 is transparent. The air bubble 26 will be centrally disposed within the vial 24 when the body 12 is oriented in a precisely horizontal position.

Access into the chamber 16 is provided by access opening 32. Access into the chamber 18 is provided by access opening 34. The access opening 32 is normally closed by means of a plastic end cap 38. The access opening 34 is normally closed by means of a plastic end cap 36. Each of the end caps 36 and 38 are to be easily manually removable to gain access into the respective chambers 18 and 16. Within chambers 16 and 18 there may be stored picture hanging articles such as hooks and fasteners such as the fastener shown within FIG. 4. The typical length of the fastener shown in FIG. 4 will be approximately one and one quarter inches.

Associated with the picture anchoring apparatus 10 of this invention will be a plurality of fasteners 42 such as shown in FIG. 4. Each fastener 42 has a sharp pointed end 44 and an enlarged head 46. The enlarged head 46 abutts against the inside surface of a strip 48 of malleable metal. The strip 48 can be readily bend to assume different configurations such as shown in phantom lines in FIG. 5.

Placed against the inner surface of the strip 48 and covering the enlarged head 46 is an adhesive pad 50. This adhesive pad 50 has an outer surface which is normally covered by a release paper 52.

Usage of the picture anchoring apparatus 10 of this invention is as follows: A plurality of the fasteners 42 are to be stored within either compartments 16 or 18. When it is desired to use the apparatus 10, the user removes the appropriate end cap 36 or 38 and removes one of the fasteners 42. The user then replaces the end cap 36 or 38 within a respective access opening 34 or 32 in a tight-fitting manner. The user then removes release paper 52 and discards such. The user then places adhesive pad 50 against the lowermost portion of the frame of a picture (not shown). If this portion of the frame of the picture is not planar, the strip 48 is to be deformed to closely conform to the particular shape of that frame member.

The user then is to place the body 12 on the top edge of the picture frame (not shown) so that the vial 24 can be readily observed. The user then adjusts the position of the picture frame on the wall until the air bubble 26 is centrally disposed within the vial 24. At this particular time, the user then presses the picture frame toward the wall which results in the pointed end 44 slightly penetrating the wall surface. The result is the picture frame is now fixed in its established position and misalignment of the picture frame due to small earthquakes, air currents, vibrations and the like will not occur.

What is claimed is:

1. A picture anchoring apparatus for fixedly positioning the frame of a picture on a vertical wall surface comprising:

a fastener having a pointed end, said pointed end for penetrating said vertical wall surface, said fastener being mounted on a strip of malleable metal, said malleable metal strip having an outer surface and an inner surface, said pointed end extending from said inner surface;

an adhesive pad fixedly mounted on said outer surface, said adhesive pad for fixing said fastener onto said frame, said malleable metal strip being physically, manually deformable to conform to the shape of said frame if the shape of said frame is other than planar; and an elongated body adapted to be conveniently grasped by a human being user, said body being substantially hollow having open ends each of which is normally closed by a end cap, said hollow being divided into a pair of storage chambers, said fastener is to be stored in a said storage chamber.

2. The picture anchoring apparatus as defined in claim 1 wherein:

said fastener including an enlarged head, said enlarged head being located intermediate said malleable metal strip and said adhesive pad

3. The picture anchoring apparatus as defined in claim 1 wherein:

said elongated body being polygonal in cross-sectional configuration to thereby facilitate resting on a planar surface, said body adapted to be located in a resting position on the upper edge of said picture frame, a level vial located within said hollow of said elongated body, said level vial being observable to ascertain whether the top edge of said picture frame is horizontal, said level vial being located between said storage chambers.

4. The picture anchoring apparatus as defined in claim 3 wherein:

one of said end caps providing access into one of said storage compartments with the other of said end caps providing access into the other of said storage compartments, each said storage compartment is to be utilized to contain picture anchoring equipment such as said fasteners.

* * * * *